US008801224B2

(12) United States Patent
Huang et al.

(10) Patent No.: US 8,801,224 B2
(45) Date of Patent: Aug. 12, 2014

(54) LED ILLUMINATION DEVICE

(75) Inventors: Tang-Chieh Huang, Tainan (TW); Yu-Tang Yen, Tainan (TW); Ching-Hao Chang, Tainan (TW); Bing-You Weng, Tainan (TW); Sunao Hsu, Tainan (TW); Yao-Wen Liu, Tainan (TW)

(73) Assignee: Parlux Optoelectronics Co., Ltd., Tainan (TW)

( * ) Notice: Subject to any disclaimer, the term of this patent is extended or adjusted under 35 U.S.C. 154(b) by 140 days.

(21) Appl. No.: 13/156,965

(22) Filed: Jun. 9, 2011

(65) Prior Publication Data

US 2012/0106153 A1 May 3, 2012

(30) Foreign Application Priority Data

Nov. 1, 2010 (TW) ..... 99221089 U

(51) Int. Cl.
*F21S 4/00* (2006.01)

(52) U.S. Cl.
USPC ..... 362/249.04; 362/227; 362/249.02; 362/646; 362/800

(58) Field of Classification Search
USPC ..... 362/227, 234, 249.01–249.02, 249.04, 362/249.07, 294, 310, 646, 800
See application file for complete search history.

(56) References Cited

U.S. PATENT DOCUMENTS

| | | | | |
|---|---|---|---|---|
| 2005/0174769 | A1 * | 8/2005 | Yong et al. | 362/235 |
| 2006/0193130 | A1 * | 8/2006 | Ishibashi | 362/227 |
| 2007/0159828 | A1 | 7/2007 | Wang | |
| 2009/0302730 | A1 * | 12/2009 | Carroll et al. | 313/46 |

FOREIGN PATENT DOCUMENTS

| | | |
|---|---|---|
| JP | 2003-059305 | 2/2003 |
| JP | 2008-124436 | 5/2008 |
| JP | 2010-135309 | 6/2010 |

OTHER PUBLICATIONS

Office action issued on 9 Nov. 2012 for the corresponding Korea Patent Application No. 20-2011-0005176 which cites references: JP 2010-135309, JP 2003-059305 and JP 2008-124436.
English translation of Office action issued on Nov. 9, 2012 for the corresponding Korea Patent Application No. 20-2011-0005176.
English Abstract of JP 2010-135309, JP 2003-059305 and JP 2008-124436.

* cited by examiner

*Primary Examiner* — Meghan Dunwiddie
(74) *Attorney, Agent, or Firm* — WPAT, P.C.; Anthony King

(57) ABSTRACT

The present invention provides an LED illumination device including a base, at least one flexible circuit board and a plurality of LEDs. The at least one flexible circuit board is used for covering the base. The LEDs are mounted on the flexible circuit board. The present invention utilizes a flexible circuit board that can conform to the base having a 360 degree curved surface and a 3D solid structure to efficiently change the viewing angle of the LEDs so as to provide 360 degree viewing angle. Furthermore, a single flexible circuit board can be utilized to cover the base to provide a 360 degree viewing angle. Therefore, the LED illumination device of the present invention can reduce manufacturing cost and simplify the manufacturing process.

13 Claims, 12 Drawing Sheets

LED ILLUMINATION DEVICE

TECHNICAL FIELD

The present invention relates to an illumination device, and more particularly, an LED illumination device using LED as light source.

BACKGROUND

Because the LED (Light Emitting Diode) offers advantages of power savings, high emission efficiency and long life, it is widely used in various applications, such as traffic control devices, electronic billboards, light of transportation, flashlights, and illumination devices.

One problem posed by use of an LED in an illumination device is that the characteristics of an LED are different from a conventional bulb. That is, a conventional bulb is a surface light source, while an LED is a point light source. Therefore, a conventional bulb can provide a 360 degree is viewing angle, but an LED can only provide a 120 to 140 degree viewing angle. Conventional techniques for overcoming this limitation include utilizing secondary optics, arranging the LEDs or polishing the lamp cover for covering the LEDs. However, even when utilizing secondary optics or providing a polished lamp cover, a conventional LED illumination device is still limited to providing a 160 degree viewing angle. People skilled in the art often arrange or assemble the LEDs to extend the viewing angle.

FIG. 1 and FIG. 2 show a conventional LED illumination device 1 as disclosed in Taiwan Patent Publication No. TW200708684. The conventional LED illumination device 1 includes a lamp cover 11, a lamp holder 12, a heat dissipating pillar 13 and three emitting units 14. The lamp cover 11 has an opening portion 111. The lamp holder 12 connects to the opening portion 111. The heat dissipating pillar 13 is mounted on the lamp holder 12, and is disposed in the lamp cover 11. Three emitting units 14 are mounted on the heat dissipating pillar 13. The heat dissipating pillar 13 is formed as a triangular body and has three slots 131 disposed apart and facing different directions. Each emitting unit 14 has a circuit board 141 and a plurality of LEDs 142. The circuit board 141 is mounted in the slot 131 of the heat dissipating pillar 13. The LEDs 142 are arranged and mounted on the circuit board 141. Consequently, the LEDs 142 emit light toward different directions.

The three emitting units 14 are arranged 120 degrees apart and each emits light in a different direction. The circuit board 141, however, is conventionally a printed circuit board, metal core printed circuit board (MCPCB), ceramic substrate ($Al_2O_3$, LTCC or AlN) or metal complex material which cannot be bent. Therefore, the LEDs 142 on each circuit board 141 are arranged on a single plate and emit light toward a single direction. The viewing angle of the conventional LED illumination device is still limited, and unable to provide a 360 degree viewing angle.

Therefore, it is necessary to provide an LED illumination device capable of overcoming the above limitations.

SUMMARY

In view of the above problems, the present invention provides an LED illumination device including a base, at least one flexible circuit board and a plurality of LEDs. The at least one flexible circuit board is used for covering the base. The LEDs are mounted on the flexible circuit board.

The present invention further provides an LED illumination device including a lamp cover, a lamp holder, a base and an emitting unit. The lamp cover has an accommodating space and an opening portion. The accommodating space has an opening, and the opening portion defines the opening. The lamp holder connects the opening portion, and the lamp holder electrically connects a power source. The base is mounted on the lamp holder and is disposed in the accommodating space of the lamp cover. The base has a 360 degree curved surface. The emitting unit is mounted on the curved surface and is electrically connected to the lamp holder. The emitting unit comprises a plurality of flexible circuit boards and a plurality of LEDs. The flexible circuit boards are adjacent to each other and are bent to cover the curved surface. The LEDs are mounted on the flexible circuit board and spaced apart. The light from the LEDs can pass through the lamp cover.

The present invention utilizes a flexible circuit board that can conform to the base having 360 degree curved surface and a 3D solid structure to efficiently change the viewing angle of the LEDs so as to provide a 360 degree viewing angle. Furthermore, a single flexible circuit board can be utilized to cover the base to provide a 360 degree viewing angle. Therefore, the LED illumination device of the present invention can reduce manufacturing cost and simplify the manufacturing process.

The foregoing has outlined rather broadly the features of the present invention so that the detailed description of the invention that follows may is be better understood. Additional features of the invention will be described hereinafter and form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The objectives of the present invention will become apparent upon reading the following description and upon reference to the accompanying drawings in which.

DETAILED DESCRIPTION

Figure 1:
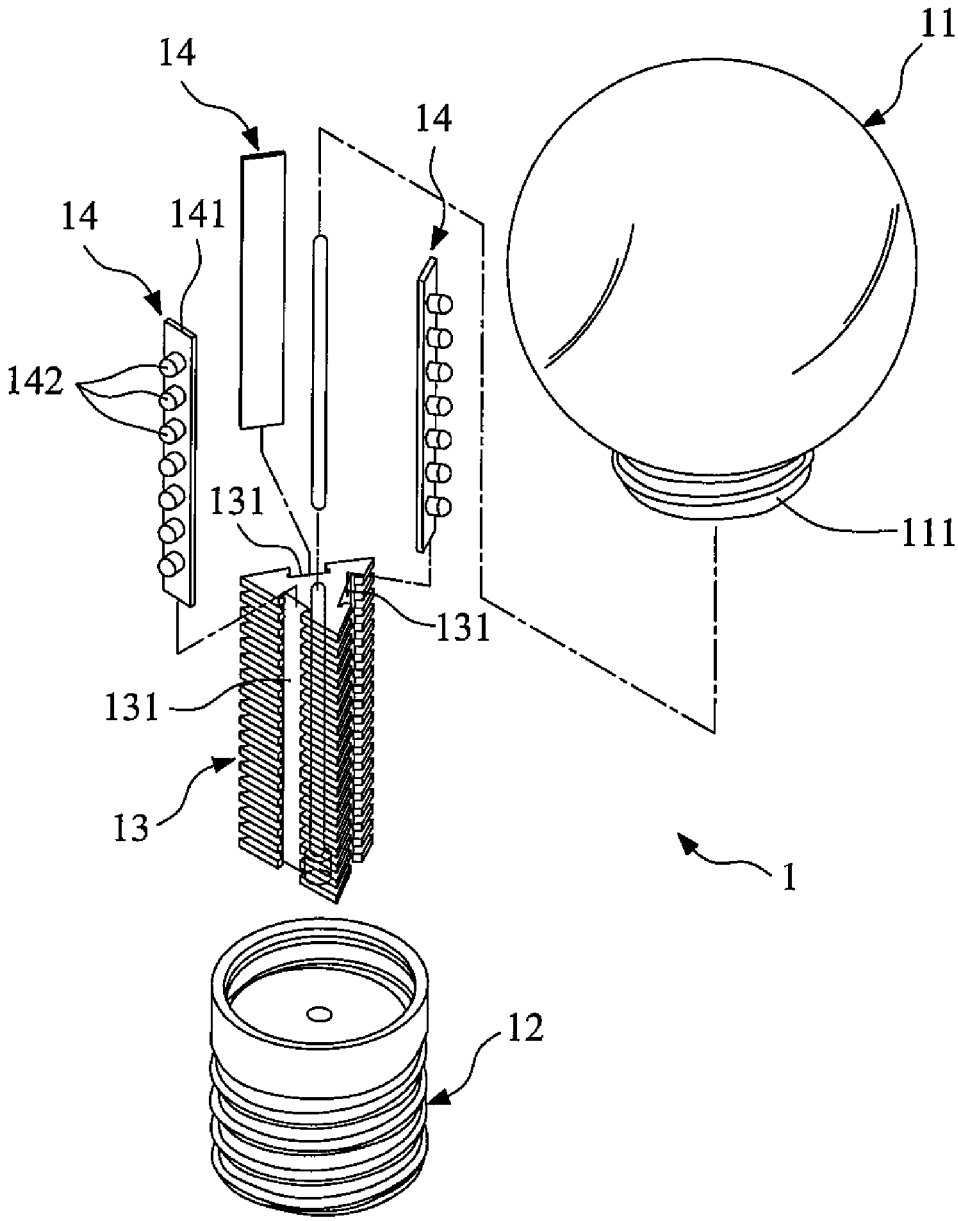
FIG. 1 (PRIOR ART)
FIG. 1 is a perspective exploded view of a conventional LED illumination device disclosed in Taiwan Patent Publication No. TW200708684.
Figure 2:
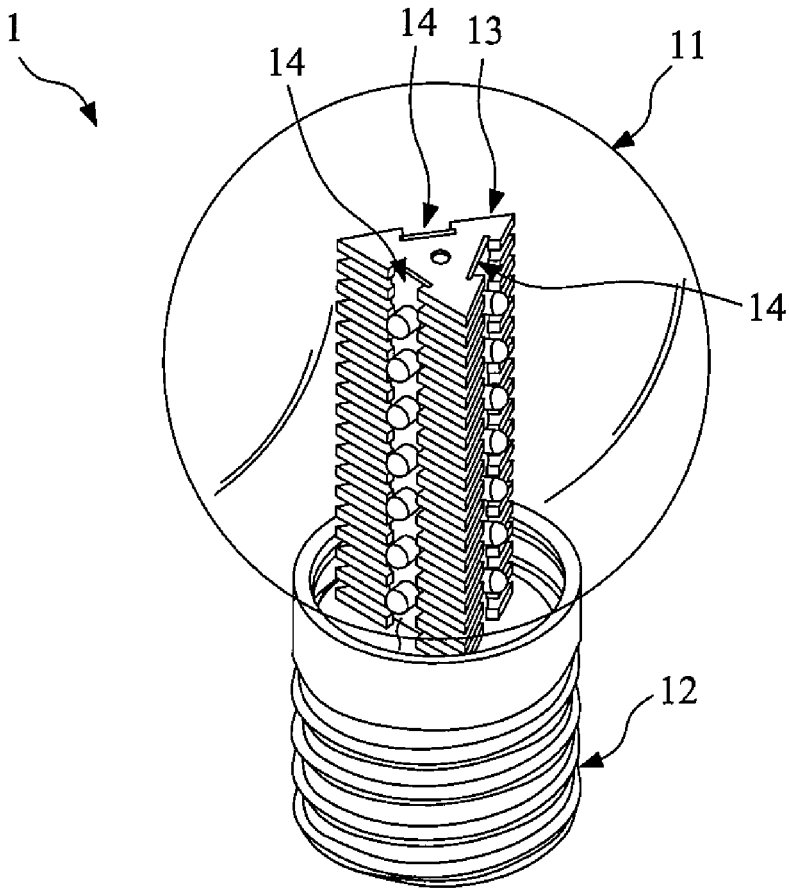
FIG. 2 (PRIOR ART)
FIG. 2 is a perspective assembled view of FIG. 1.
Figure 3:
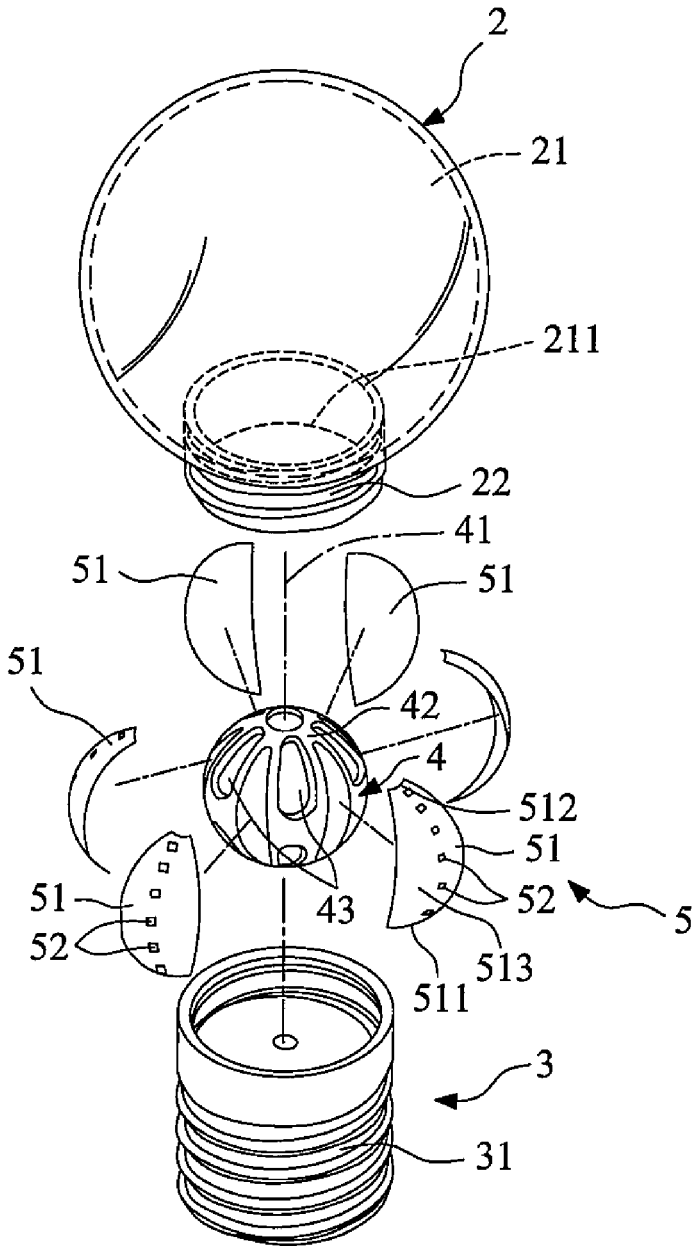
FIG. 3 is a perspective exploded view of an LED illumination device according to a first embodiment of the invention.
Figure 4:
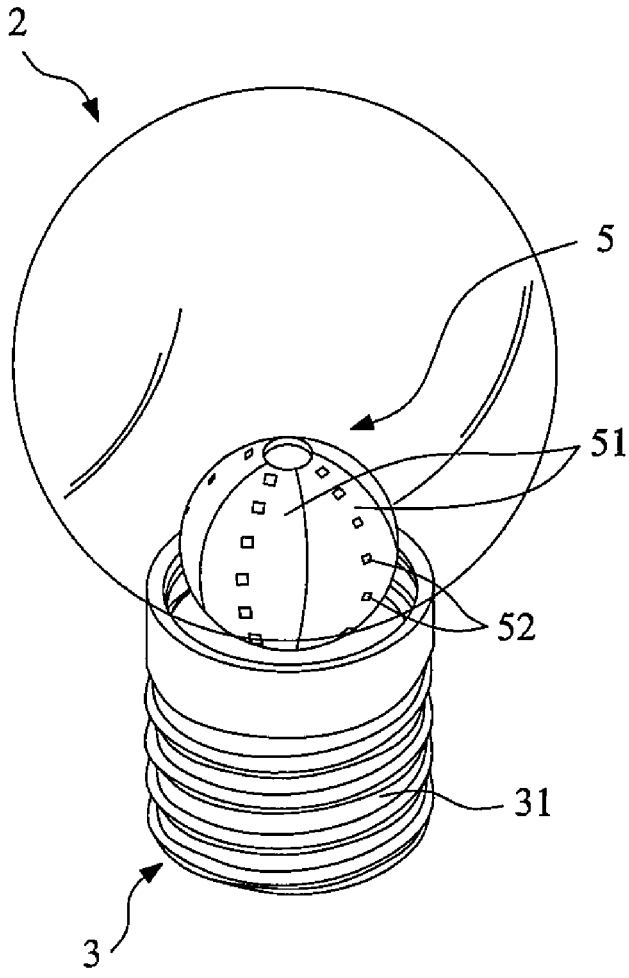
FIG. 4 is a perspective assembled view of the LED illumination device according to the first embodiment of the invention.

Referring to FIGS. 3 and 4, according to a first embodiment of the invention, the LED illumination device includes a lamp cover 2, a lamp holder 3, a base 4 and an emitting unit 5. The lamp cover 2 is made of glass or plastic, and the shape of the lamp cover 2 is similar to that of the conventional bulb, but is not limited thereto. The lamp cover 2 has an accommodating space 21 and an opening portion 22. The accommodating space 21 has an opening 211, and the opening portion 22 defines the opening 211.

The lamp holder 3 connects to the opening portion 22, and the lamp holder 3 includes a surface 31 with screw thread for mounting on a lampstand (not shown in the drawings) so that the lamp holder 3 can be mounted on a building or on another illumination device such as desk lamp or floor lamp. The lamp holder 3 further includes an AC/DC converter circuit (not shown in the drawings) for electrically connecting a power source so as to transmit the power of the power source to the emitting unit 5.

The base 4 is formed as a hollow spheral shape, and is made of material with good heat dissipation characteristics. The base 4 is mounted on the lamp holder 3, and is disposed in the accommodating space 21 of the lamp cover 2. An axis 41 is defined as traversing the center of the lamp is holder 3 and the lamp cover 2. The surface 42 of the base 4 is curved 360 degrees, and the base 4 has a plurality of first heat dissipating holes 43 for dissipating heat. In this embodiment, the curved surface 42 is a spheral surface. In the other embodiments, the curved surface 42 may be formed as a cylindrical shape, a conical shape, a heart shape, a flower shape or other regular or irregular shape. In addition, the number of curved surfaced 42 can be adjusted according to need, and is not limited.

The emitting unit 5 is mounted on the curved surface 42 and is electrically connected to the lamp holder 3. The emitting unit 5 comprises a plurality of flexible circuit boards 51 and a plurality of LEDs 52. The six flexible circuit boards 51 are adjacent to each other, and are bent to cover the curved surface 42. The LEDs 52 are mounted on the flexible circuit board 51 and spaced apart.

Each flexible circuit board 51 is a bendable flexible printed circuit board (FPC), and offers the advantages of being light weight, bendable, thin, and providing high thermal conductivity. In this embodiment, each flexible circuit board 51 is an eye-shaped plate having two sharp end portions 511 512 and a wide middle portion 513. The two sharp end portions comprise a first end portion 511 and a second end portion 512; the first end portion 511 is close to the lamp holder 3; the second end portion 512 is far away from the lamp holder 3 and corresponds to the first end portion 511. The wide middle portion 513 is disposed between the first end portion 511 and the second end portion 512. Each flexible circuit board 51 is bent to conform to the base 42; that is, the flexible circuit board 51 is bent from the first end portion 511 to the wide middle portion 513 along a first direction far away from the axis 41, and from the wide middle portion 513 to the second end portion 512 along a second direction close to the axis 41.

The above flexible circuit boards 51 surround the axis 41; that is, they encircule it 360 degrees. The flexible circuit boards 51 entirely cover the base 4, and extend the viewing angle of the LEDs 52 to provide a 360 is degree viewing angle. Each flexible circuit board 51 can have a plurality of second heat dissipating holes (not shown in the drawings) for dissipating heat.

The LEDs 52 have advantages of high luminance, power savings, high emitting efficiency and long life. Since the LEDs 52 are mounted on the flexible circuit board 51, the light from the LEDs 52 can pass through the lamp cover 2 to provide a 360 degree viewing angle. In practice, the number of flexible circuit boards 51 and LEDs 52 can be adjusted depending on the structure of the base 4, and are not limited.

Figure 5:
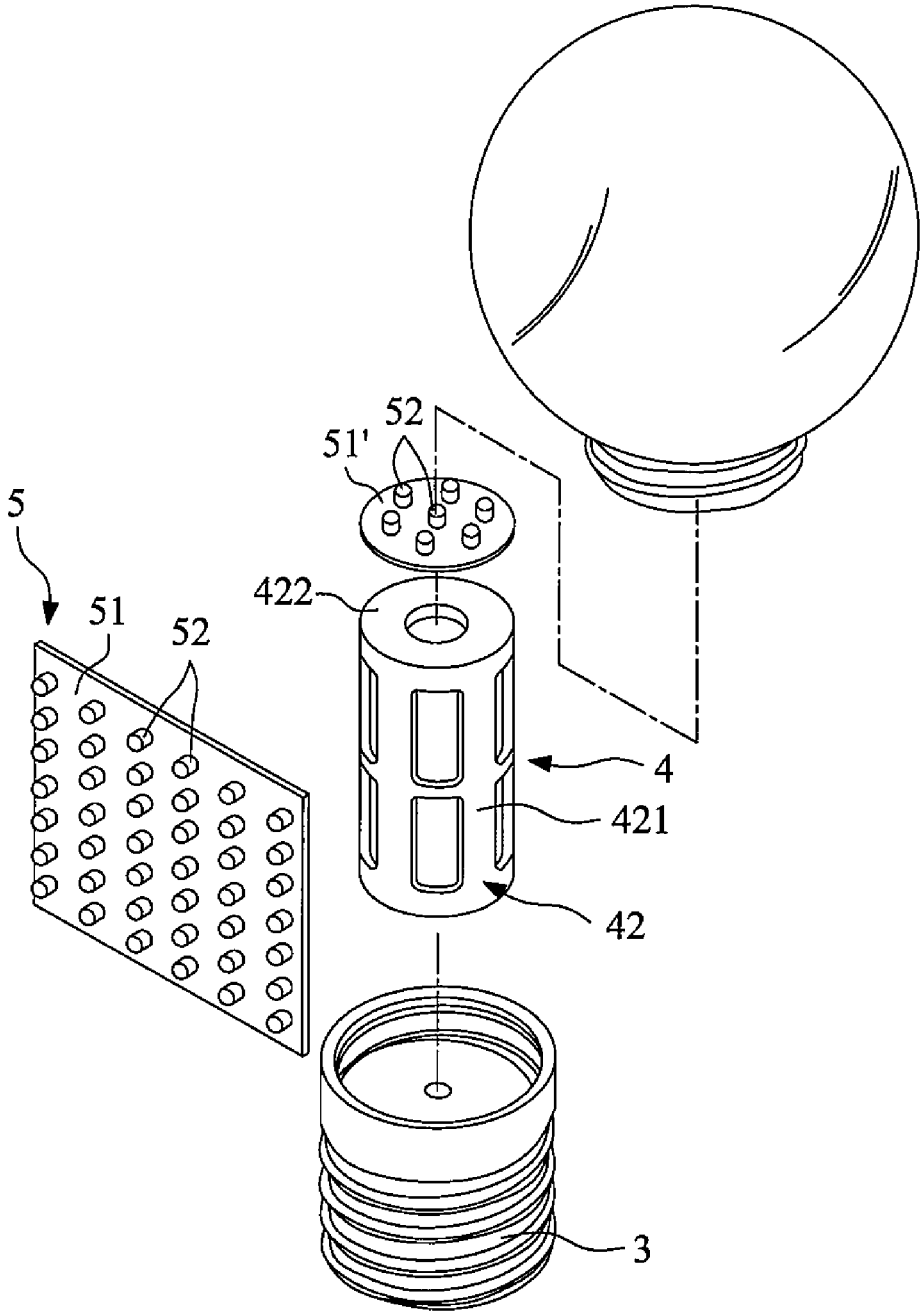
FIG. 5 is a perspective exploded view of an LED illumination device according to a second embodiment of the invention.
Figure 6:
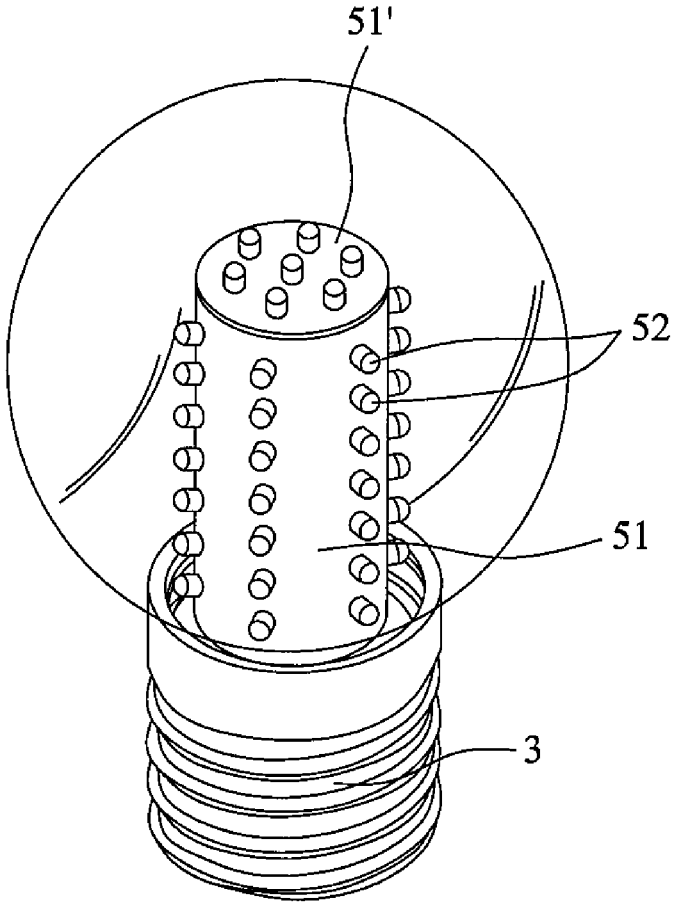
FIG. 6 is a perspective assembled view of the LED illumination device according to the second embodiment of the invention.

Referring to FIGS. 5 and 6, the LED illumination device according to a second embodiment of the invention is substantially similar to the LED illumination device according to the first embodiment of the invention; the difference is the structure of the base 4. In this embodiment, the base 4 is formed as a hollow cylindrical shape. The curved surface 42 comprises a hollow cylindrical surface portion 421 and a circular surface portion 422; the circular surface portion 422 is disposed on one side of the hollow cylindrical surface portion 421, and is far away from the lamp holder 3. In this embodiment, the circular surface portion 422 is a flat sheet. In other embodiments, the circular surface portion 422 may be a protrusive arc sheet extending the viewing angle of the LEDs 52. The emitting unit 5 comprises a first flexible circuit board 51 and a second flexible circuit board 51'; the first flexible circuit board 51 is disposed on the hollow cylindrical surface portion 421 of the base 4, and the second flexible circuit board 51' is disposed on the circular surface portion 422.

Given the above, the LED illumination device of the invention utilizes the flexible circuit board 51 to replace the conventional hard substrate, and utilizes the 360 degree base 4 to extend the viewing angle provided by the emitting unit 5. Therefore, the LED illumination device of the invention provides a 360 degree viewing angle, thereby overcoming the limited viewing angle of conventional LED illumination devices.

Figure 7:
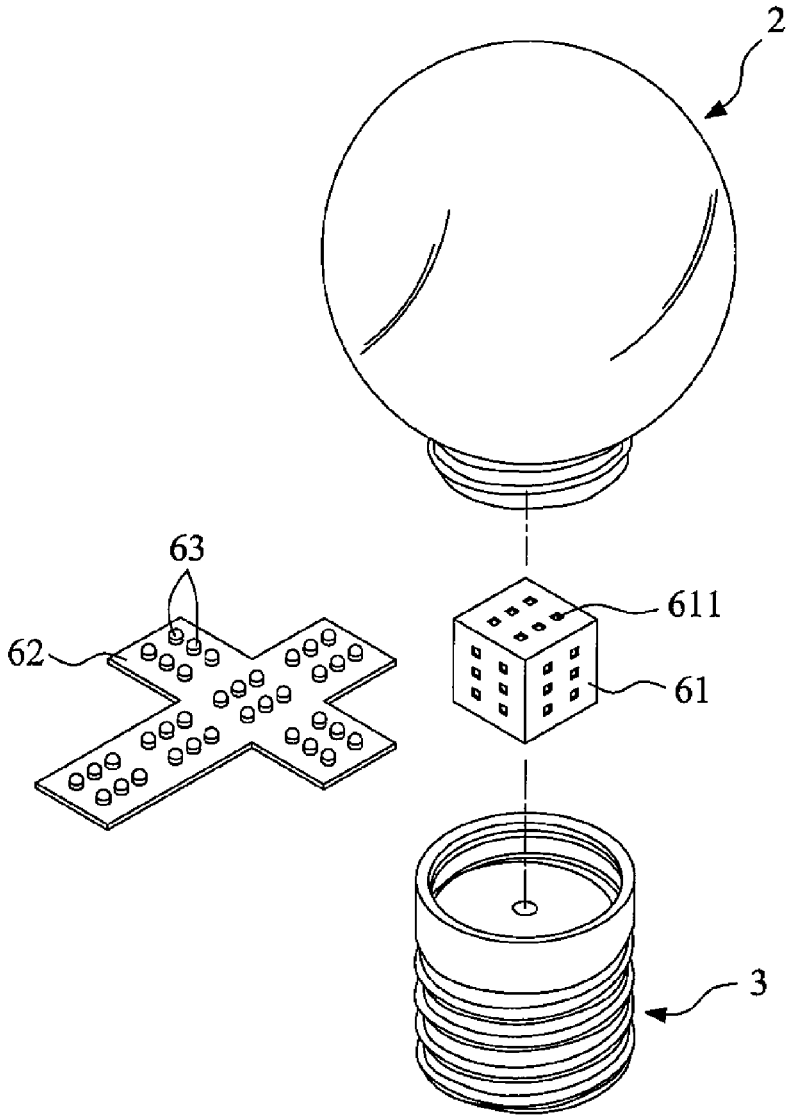
FIG. 7 is a perspective exploded view of an LED illumination device according to a third embodiment of the invention.

Referring to FIG. 7, the lamp cover 2 and the lamp holder 3 of the LED illumination device according to a third embodiment of the invention are the same as those of the above embodiments. In this embodiment, the base 61 is formed as a rectangular body, such as a cube or rhombus. The base 61 can be a hollow rectangular body and has a plurality of first heat dissipating holes 611 for dissipating heat.

The flexible circuit board 62 is formed as a cross shape. The width of the flexible circuit board 62 corresponds to that of the base 61, and the flexible circuit board 62 can be bent to entirely cover the base 61. A plurality of LEDs 63 are mounted on the flexible circuit board 62. After the flexible circuit board 62 covers the base 61, the LEDs 63 are disposed on each surface of the base 61. A corner of the base 61 is mounted on the lamp holder 3 so that the LEDs 63 disposed on each surface of the base 61 can be exposed to provide a 360 degree viewing angle.

Figure 8:
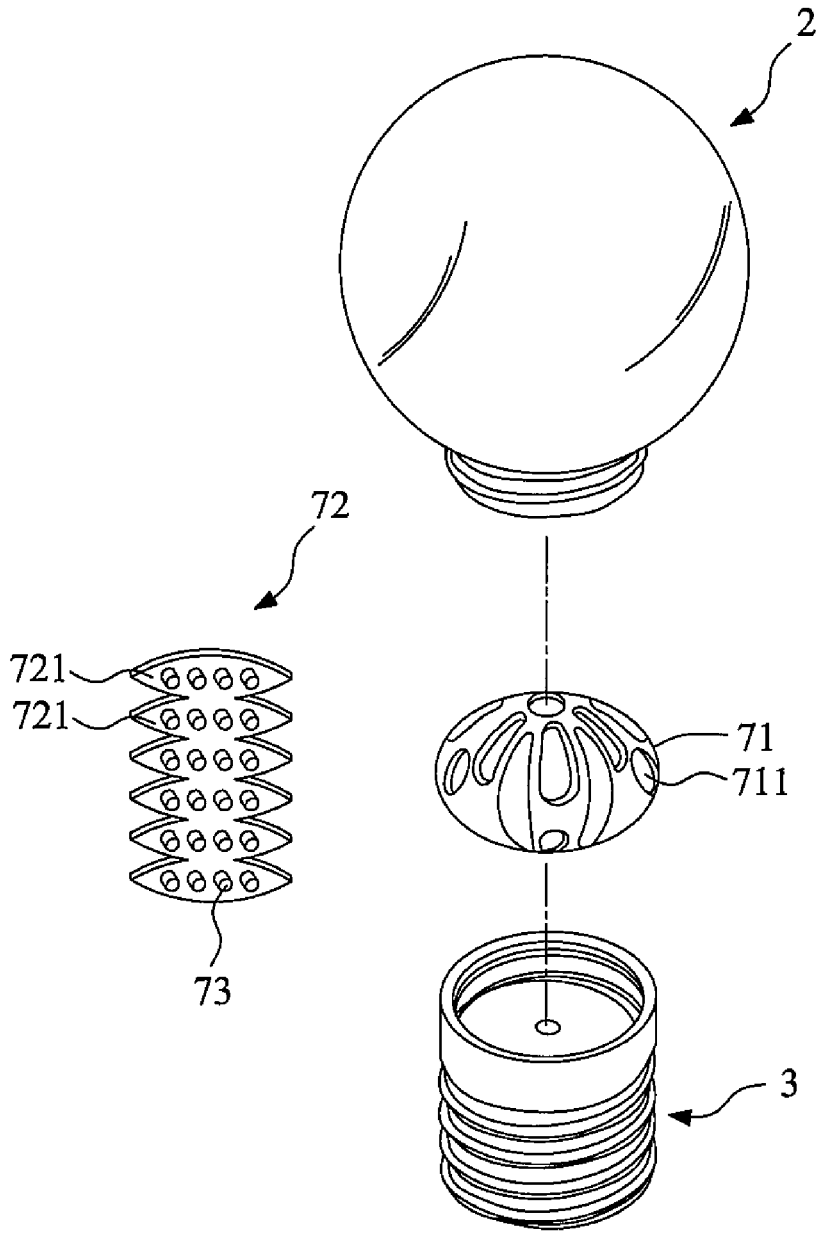
FIG. 8 is a perspective exploded view of an LED illumination device according to a fourth embodiment of the invention.

Referring to FIG. 8, the lamp cover 2 and the lamp holder 3 of the LED illumination device according to a fourth embodiment of the invention are the same as those of the above embodiments. In this embodiment, the base 71 is formed as an oval body. The dimensions of the long short sides can each be adjusted according to need. The base 71 can be a hollow oval body, and has a plurality of first heat dissipating holes 711 for dissipating heat.

The flexible circuit board 72 comprises a plurality of leaf portions 721 which partially connect to each other. For example, the middle section of the leaf portion 721 connects to that of the other leaf portion 721 so as to form a single flexible circuit board 72. The flexible circuit board 72 can be bent to entirely cover the base 71. A plurality of the LEDs 73 are mounted on the flexible circuit board 72. After the flexible circuit board 72 covers the base 71, the LEDs 73 are disposed on the 360 degree curved surface of the base 71. An end of the long side of the base 71 is mounted on the lamp holder 3 so that the LEDs 73 disposed on the 360 degree curved surface of the base 71 can be exposed to provide a 360 degree viewing angle.

Figure 9:
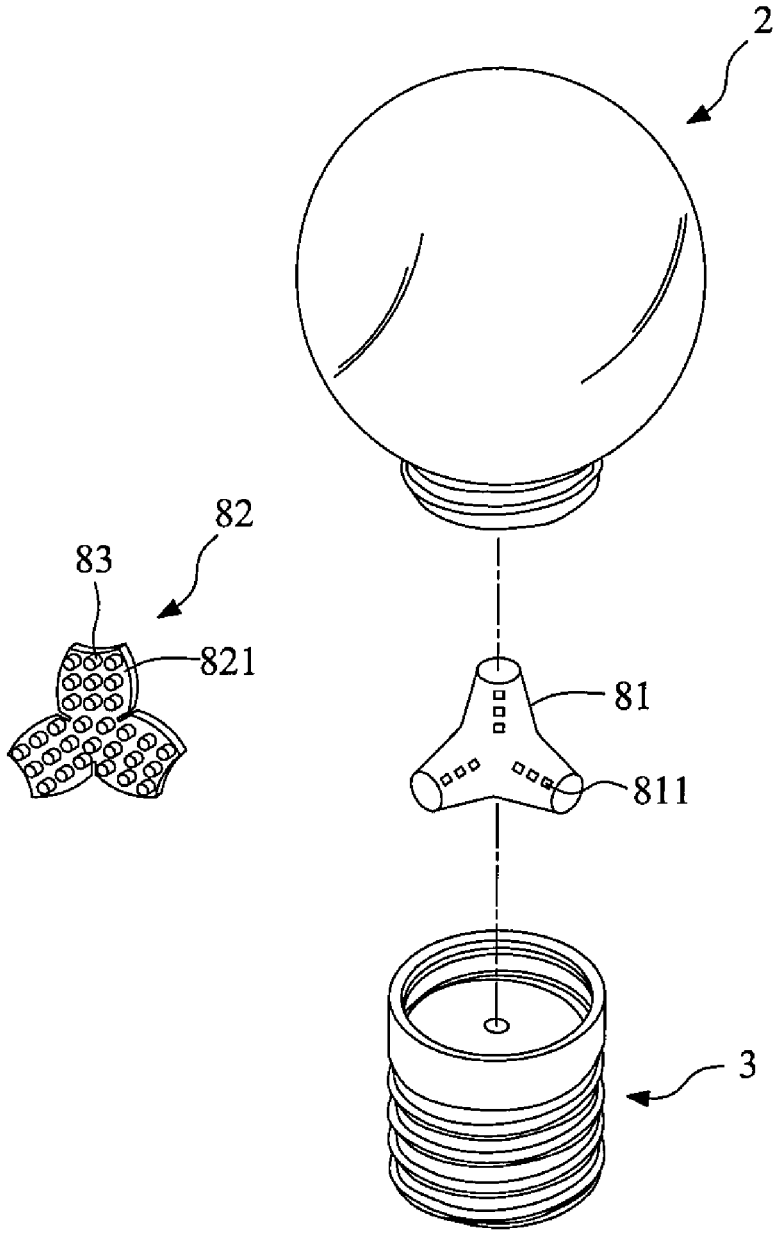
FIG. 9 is a perspective exploded view of an LED illumination device according to a fifth embodiment of the invention.

Referring to FIG. 9, the lamp cover 2 and the lamp holder 3 of the LED illumination device according to a fifth embodiment of the invention are the same as those of the above embodiments. In this embodiment, the base 81 is formed as a tetrapod structure. The base 61 can be a hollow tetrapod structure, and has a plurality of first heat dissipating holes 811 for dissipating heat.

The flexible circuit board 82 is formed as a petal shape, and comprises a plurality of petal portions 821. The size and number of petal portions 821 correspond to the base 81, and the flexible circuit board 82 can be bent to entirely cover the base 81. A plurality of the LEDs 83 are mounted on the flexible circuit board 82. After the flexible circuit board 82 covers the base 81, the LEDs 83 are disposed on the curved surface of the base 81. The base 81 is mounted on the lamp holder 3 so that the LEDs 83 disposed on the curved surface of the base 81 can be exposed to provide a 360 degree viewing angle.

Figure 10A:
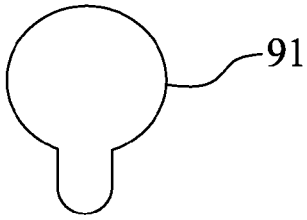
FIGS. 10A to 10C show various types of base according to the LED illumination device of the invention.
Figure 10B:
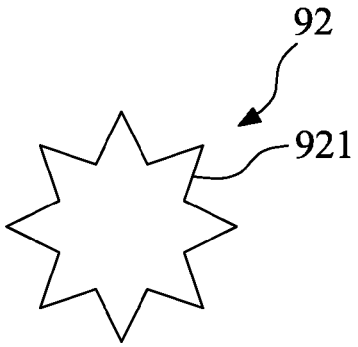
Figure 10C:
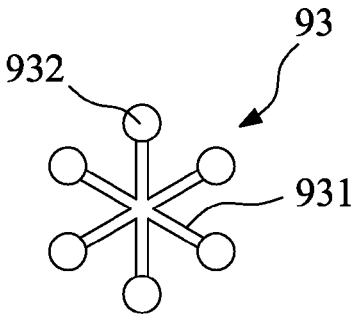

FIGS. 10A to 10C show various types of base according to the LED illumination device of the invention. Referring to FIG. 10A, the base 91 is formed as a bulb body. Referring to FIG. 10B, the base 92 comprises a plurality of taper portions 921 extending outwardly. Referring to FIG. 10C, the base 93 comprises a plurality of braces 931 and a plurality of points 932; each brace 931 has two ends, one of which connects the brace to another; the braces 931 extend outwardly, the points 932 are disposed on the other end of each brace 931. The above bases can be covered by at least one flexible circuit board so that the LEDs are disposed on the curved surface of the base to provide a 360 degree viewing angle.

Figure 11:
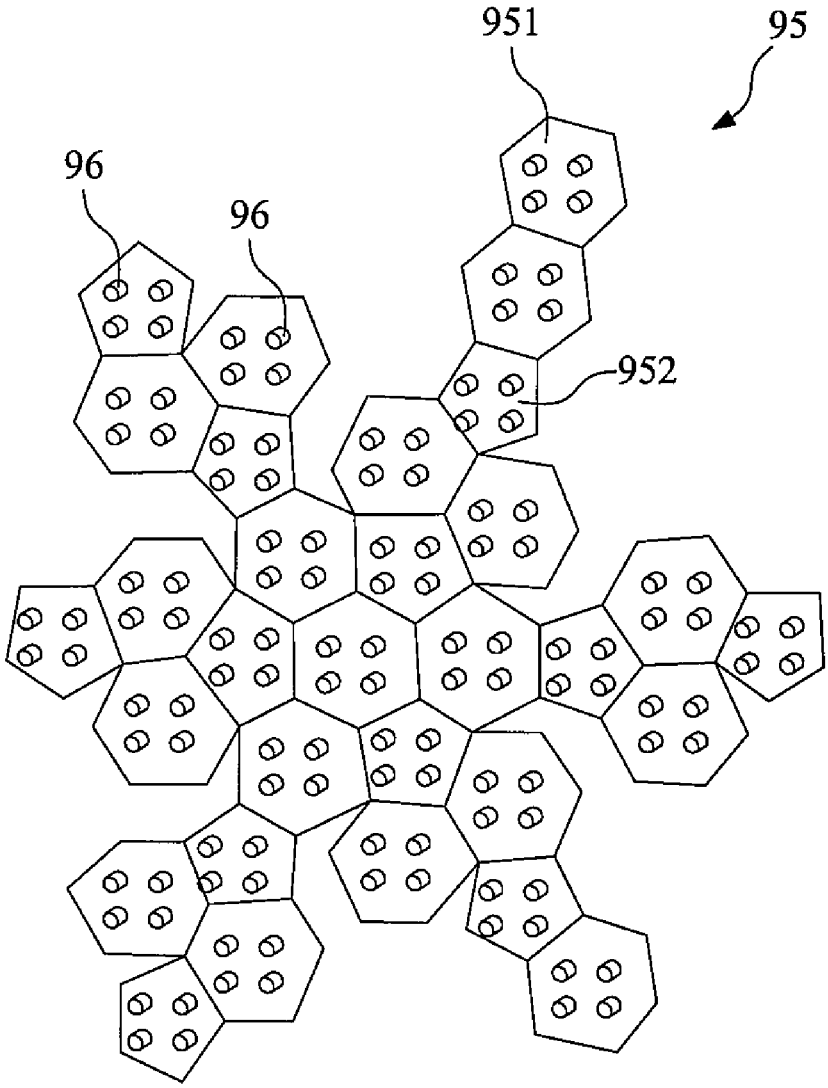
FIG. 11 shows a type of flexible circuit board according to the LED illumination device of the invention.

FIG. 11 shows another type of flexible circuit board according to the LED illumination device of the invention. The flexible circuit board 95 is formed as a buckyball expansion shape to cover the base to form a buckyball. The flexible circuit board 95 includes a plurality of hexagon portions 951 and a plurality of pentagon portions 952. The hexagon portion 951 and the pentagon portion 952 connect to each other to form a single flexible circuit board 95. The flexible circuit board 95 can cover the base 92 as shown in FIG. 10B, the base 93 as shown in FIG. 10C or another base, to form a buckyball so that the LEDs 96 disposed on the flexible circuit board 95 provide a 360 degree viewing angle.

Figure 12:
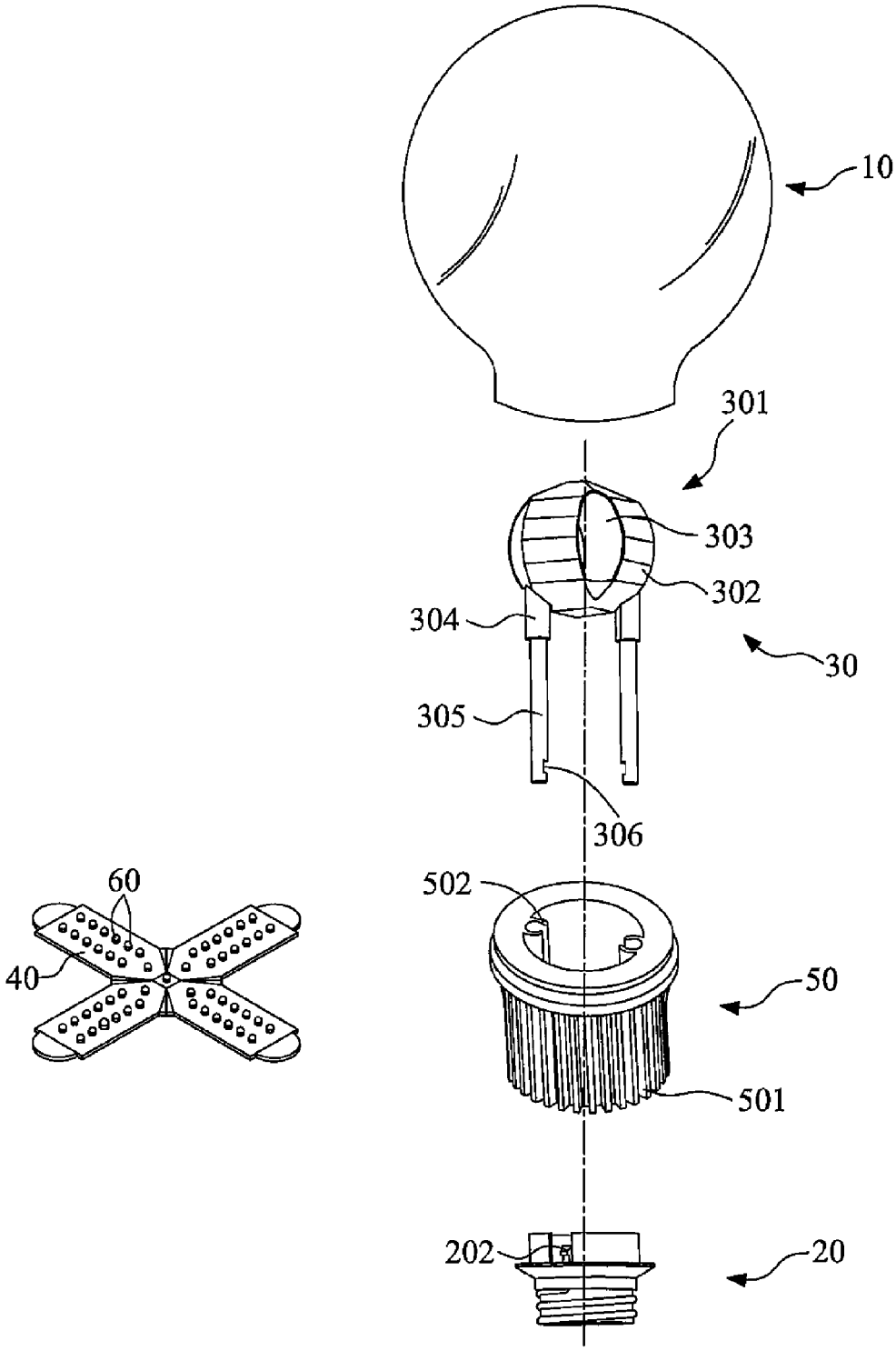
FIG. 12 is a perspective exploded view of an LED illumination device according to a sixth embodiment of the invention.

Referring to FIG. 12, it shows a perspective exploded view of an LED illumination device according to a sixth embodiment of the invention. The LED illumination device includes a lamp cover 10, a lamp holder 20, a base 30, a flexible circuit board 40 and a heat dissipating body 50. The base 30 includes a supporting body 301 formed as a hollow spheral shape. The supporting body 301 includes a plurality of supporting portions 302. A plurality of heat dissipating holes 303 are disposed between the supporting portions 302. In this embodiment, the supporting portions 302 are formed as a plate shape and are connected on a top portion and a bottom portion of the supporting body 301. The number and width of the supporting portions 302 can each be adjusted according to need.

In addition to dissipating heat, the heat dissipating holes 303 can discharge the middle portion of the supporting body 301 when the supporting body 301 is manufactured. Thus, there is no thick portion in the supporting body 301 to avoid the crack in the supporting body 301 due to cooling. Thus, the supporting body 301 can be formed perfectly and can avoid the heat accumulated in the supporting body 301.

The flexible circuit board 40 is formed as a cross shape to cover the supporting portions 302 of the base 30. The width of the flexible circuit board 40 conforms to that of the supporting portions 302, and the flexible circuit board 40 can be bent to entirely cover the supporting portions 302.

A plurality of LEDs 60 are mounted on the flexible circuit board 40. After the flexible circuit board 40 covers the supporting portions 302, the LEDs 60 can emit toward different directions to provide a 360 degree viewing angle.

The base 30 further includes a plurality of heat dissipating pillars 304 downwards extending from an edge of the supporting body 301. The base 30 further includes a plurality of first connecting portions 305 connected to the heat dissipating pillars 304 respectively and downwards extending from the heat dissipating pillars 304. In this embodiment, the first connecting portion 305 is formed as a pillar shape, and the diameter of the first connecting portions 305 is smaller than that of the heat dissipating pillars 304.

The heat dissipating body 50 is mounted between the lamp cover 10 and the lamp holder 20. The heat dissipating body 50 includes a plurality of heat dissipating fins 501 and a plurality of second connecting portions 502. The heat dissipating fins 501 are disposed on the peripheral of the heat dissipating body 50 to increase the area of dissipating surface so as to increase dissipation efficiency.

The second connecting portions 502 correspond to the first connecting portions 305, and are connected to the first connecting portions 305. In this embodiment, each second connecting portion 502 includes two arc portions to form a cylindrical space for accommodating the first connecting portion 305. After the first connecting portions 305 are mounted in the second connecting portions 502, the heat dissipating pillars 304 contact a top surface of the heat dissipating body 50 so that the heat from the LEDs 60 can be conducted to the heat dissipating body 50 via the supporting body 301 and the heat dissipating pillars 304 to increase dissipation efficiency.

Each first connecting portion 305 includes a first hook portion 306. In this embodiment, the first hook portion 306 is formed as a hook shape inwards. The lamp holder 20 has a plurality of second hook portions 202 corresponding to the first hook portions 306, the second hook portions 202 are connected to the first hook portions 306. In this embodiment, the second hook portion 202 is formed as a hook shape outwards to conform to the first hook portion 306. Thus, after the first connecting portions 305 are mounted in the second connecting portions 502, the first hook portions 306 and the second hook portions 202 are engaged to fix the base 30.

According to the above embodiments as shown in FIGS. 7 to 12, a single flexible circuit board can be utilized to match the shape of the base and cover the base to provide a 360 degree viewing angle. Therefore, the LED illumination device of the present invention can reduce manufacturing cost and simplify the manufacturing process. Furthermore, the heat dissipating pillars and the heat dissipating body can be utilized to increase dissipation efficiency. In addition, the first hook portions and the second hook portions can be utilized to fix the base.

Although the present invention and its objectives have been described in detail, it should be understood that various changes, substitutions and alterations can be made herein without departing from the spirit and scope of the invention as defined by the appended claims. For example, many of the processes discussed above can be implemented using different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacturing methods, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacturing methods, compositions of matter, means, methods, or steps.

What is claimed is:

1. An LED illumination device, comprising:

a base, comprising a supporting body formed as a spheral shape, the supporting body comprising a plurality of supporting portions;

at least one flexible circuit board, formed as a petal shape, and comprising a plurality of petal portions for covering the supporting portions of the base; and a plurality of LEDs, mounted on the flexible circuit board;

wherein the supporting body formed as a hollow spheral shape; a plurality of heat dissipating holes are disposed between the supporting portions; the flexible circuit board is formed as a cross shape to cover the supporting portions.

2. The LED illumination device of claim 1, further comprising a lamp cover and a lamp holder, the lamp cover having an accommodating space and an opening portion, the lamp holder being connected to the opening portion, and the lamp holder being electrically connected to a power source.

3. The LED illumination device of claim 1, wherein the flexible circuit board is flexible printed circuit board.

4. The LED illumination device of claim 1, wherein the base is formed as an oval body.

5. The LED illumination device of claim 1, wherein the base is formed as a bulb body.

6. The LED illumination device of claim 1, wherein the base comprises a plurality of taper portions extending outwardly.

7. The LED illumination device of claim 1, wherein the flexible circuit board is formed as a cross shape.

8. The LED illumination device of claim 1, wherein the base further comprises a plurality of heat dissipating pillars downwards extending from an edge of the supporting body.

9. The LED illumination device of claim 8, wherein the base further comprises a plurality of first connecting portions connected to the heat dissipating pillars respectively and downwards extending from the heat dissipating pillars.

10. The LED illumination device of claim 9, further comprising a lamp cover, a heat dissipating body and a lamp holder, wherein the heat dissipating body is mounted between the lamp cover and the lamp holder; the heat dissipating body comprises a plurality of heat dissipating fins and a plurality of second connecting portions, the heat dissipating fins are disposed on the peripheral of the heat dissipating body; the second connecting portions correspond to the first connecting portions, and are connected to the first connecting portions.

11. The LED illumination device of claim 10, wherein each first connecting portion comprises a first hook portion; the lamp holder comprises a plurality of second hook portions corresponding to the first hook portions, the second hook portions are connected to the first hook portions.

12. An LED illumination device, comprising:

a base;

at least one flexible circuit board, for covering the base;

a plurality of LEDs, mounted on the flexible circuit board; and a lamp cover and a lamp holder, the lamp cover having an accommodating space and an opening portion, the lamp holder being connected to the opening portion, and the lamp holder being electrically connected to a power source;

wherein the base is mounted on the lamp holder, and is disposed in the accommodating space of the lamp cover, the base has a 360 degree curved surface, and is formed as a hollow spheral shape; an axis is defined by traversing the center of the lamp holder and the lamp cover; the at least one flexible circuit board comprises a plurality of flexible circuit boards surrounding the axis averagely; each flexible circuit board is an eye-shaped plate having a wide middle portion and two sharp end portions; the flexible circuit board is bent to conform to the base; two sharp end portions comprise a first end portion and a second end portion; the first end portion is close to the lamp holder; the second end portion is far away from the lamp holder, and corresponds to the first end portion; the wide middle portion is disposed between the first end portion and the second end portion; the flexible circuit board is bent from the first end portion to the wide middle portion along a first direction far away from the axis, and from the wide middle portion to the second end portion along a second direction close to the axis.

13. An LED illumination device, comprising:

a base;

at least one flexible circuit board, for covering the base;

a plurality of LEDs, mounted on the flexible circuit board; and a lamp cover and a lamp holder, the lamp cover having an accommodating space and an opening portion, the lamp holder being connected to the opening portion, and the lamp holder being electrically connected to a power source;

wherein the base is mounted on the lamp holder, and is disposed in the accommodating space of the lamp cover, the base has a 360 degree curved surface, and is formed as a hollow cylindrical shape; the curved surface comprises a hollow cylindrical surface portion and a circular surface portion; the circular surface portion is disposed on one side of the hollow cylindrical surface portion, and is far away from the lamp holder; the at least one flexible circuit board comprise a first flexible circuit board and a second flexible circuit board; the first flexible circuit board is disposed on the hollow cylindrical surface portion of the base; the second flexible circuit board is disposed on the circle surface portion.

* * * * *